United States Patent [19]

Congdon

[11] Patent Number: 4,706,229

[45] Date of Patent: Nov. 10, 1987

[54] ELECTROACOUSTIC TRANSDUCER

[75] Inventor: John C. Congdon, Fort Wayne, Ind.

[73] Assignee: Magnavox Government and Industrial Electronics Company, Fort Wayne, Ind.

[21] Appl. No.: 906,450

[22] Filed: Sep. 12, 1986

Related U.S. Application Data

[60] Continuation of Ser. No. 748,753, Jun. 26, 1985, abandoned, which is a division of Ser. No. 446,330, Dec. 2, 1982, Pat. No. 4,546,459.

[51] Int. Cl.[4] ..... H04R 17/00

[52] U.S. Cl. ..... 367/159; 367/164; 367/166; 310/337; 310/369

[58] Field of Search ..... 367/2-6, 367/141, 151-155, 157, 159, 162-166, 169, 171, 173, 174, 176-178, 180, 188, 189; 181/104, 110, 122, 139, 142, 402; 310/322, 326, 327, 335, 337, 345, 353, 366, 369

[56] References Cited

U.S. PATENT DOCUMENTS

| | | | |
|---|---|---|---|
| 3,144,630 | 8/1964 | Clark | 367/3 |
| 3,249,913 | 5/1966 | Smyth et al. | 367/165 X |
| 3,264,604 | 8/1966 | Bartlett | 367/141 |
| 3,309,653 | 3/1967 | Martin et al. | 367/155 X |
| 3,444,508 | 5/1969 | Granfors et al. | 367/126 |
| 3,659,258 | 4/1972 | Abbott | 367/157 |
| 3,972,018 | 7/1976 | Erickson | 367/166 |
| 4,390,976 | 6/1983 | Eynck | 367/152 X |

*Primary Examiner*—Donald P. Walsh
*Assistant Examiner*—Brian S. Steinberger
*Attorney, Agent, or Firm*—Richard T. Seeger

[57] ABSTRACT

An electroacoustic transducer ring has an inner vibratile surface defining a ring cavity with a plurality of arcuately spaced electrodes affixed thereto. Planar partitions are placed in the ring cavity. The partition edges are parallel to the ring axis and are attached by a resilient strip to the ring inner surface in the arcuate spacing between the electrodes. The partitions have substantially continuous radial surfaces and when the partitions are substantially coextensive in the axial direciton with the ring axis optimal chordal and diametral isolation between the electrodes is provided.

17 Claims, 12 Drawing Figures

ELECTROACOUSTIC TRANSDUCER

CROSS-REFERENCES TO RELATED APPLICATIONS

This application is a continuation of my copending application Ser. No. 06/748,753 filed June 26, 1985 entitled "Electroacoustic Transducer", now abandoned which is a division application of my copending parent application entitled "Method and Apparatus for a Phased Array Transducer", Ser. No. 06/446,330, filed Dec. 2, 1982, now U.S. Pat. No. 4,546,459 and incorporated herein by reference.

BACKGROUND OF THE INVENTION

1. Field of the Invention

This invention is in the field of electroacoustic transducers and more particularly to ring transducers having directional field patterns for use in liquid environments.

2. Description of the Prior Art

Ring shaped electroacoustic transducers having a ring cavity for converting between electrical signals and acoustic waves in liquid environments are in common use. Such transducers are frequently used in water immersed and flooded sonobuoys where directional response patterns are desirable. This invention provides an electroacoustic transducer with improved definition of such response patterns resulting in improved efficiency of operation and improved sensitivity of the transducer.

SUMMARY OF THE INVENTION

A ring electroacoustic transducer has an end to end axis and a ring inner surface defining a ring cavity. Four arcuately closely spaced quadrant electrodes are bonded to or deposited on the ring inner surface and have electrode leads conductively coupled thereto in conventional manner. Each electrode covers approximately one quadrant of the ring inner surface.

A baffle comprised of four planar partitions each of which extends from the ring axis to a respective arcuate spacing between the electrodes. The partition ends are attached, as by bonding, to the ring inner surface with a resilient strip that permits substantially unrestricted operational vibration of the inner surface and at the same time provides a seal between the partition ends and the inner surface. The partitions have continuous surfaces substantially axially coextensive with the transducer ring to provide partitioned sectors in the cavity that are isolated from one another in chordal and diametral directions. The axial ends of the baffle are open to provide substantially unobstructed acoustic wave travel axially of the ring transducer.

The ring cavity is thus sectored by the partitions, each sector isolating a respective electrode from the electrodes of other sectors in a chordal and diametral directions. This sectoring provides a predetermined acoustic wave pressure isolation in a liquid filled cavity between the sectors and thus between their respective electrodes. This pressure isolation increases the pressure gradient across a flooded or liquid filled cavity and improves the directional patterns, sensitivity and response of the transducer.

In an embodiment of the invention, a cylindrical elongated tube is adapted to be suspended underwater in a vertical attitude and a cylindrical piezoelectric ring transducer element has attached to its surfaces a plurality of arcuately spaced electrodes for providing in the horizontal plane a sine/cosine like and/or omnidirectional pattern. A partitioning baffle is provided inside a flooded cylindrical transducer element for diametrically subdividing the internal volume into four equal (pie-shaped) sections, each one of the volume sections acoustically communicating with the transmission medium within the tube and each one of the sections physically related to a different quadrant of the sine/cosine like directional pattern. The partitioning baffle results in improved acoustic loading and coupling of the element to the internal transmission medium with an accompanying improvement in the horizontal directional pattern of the array by preserving the pressure gradient diametrically across the cavity of the transducer element.

Therefore it is an object of this invention to provide an electroacoustic transducer having improved response, sensitivity and transmit/receive directional patterns.

It is a further object of this invention to provide an electroacoustic ring having an end to end axis having planar radial partitions in the ring cavity so that the cavity is open ended axially and is transversely sectored to provide a predetermined acoustical wave pressure isolation between the sectors.

It is a further object to provide in the ring transducer of the previous object partitions that provide predetermined chordal and diametral isolation between the ring sectors.

It is a still further object to provide in the transducer of the previous objects a resilient strip affixed between the partition edges and the inner surface of the ring to provide substantially unrestricted operational vibration of the ring and still provide optimal chordal and diametral isolation between the sectors.

The above mentioned and other features and objects of this invention and the manner of obtaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
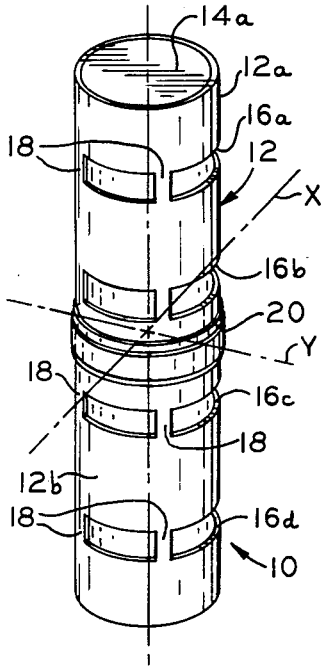
FIG. 1 is a view in perspective of a phased array transducer that may be used with the present invention.
Figure 2:
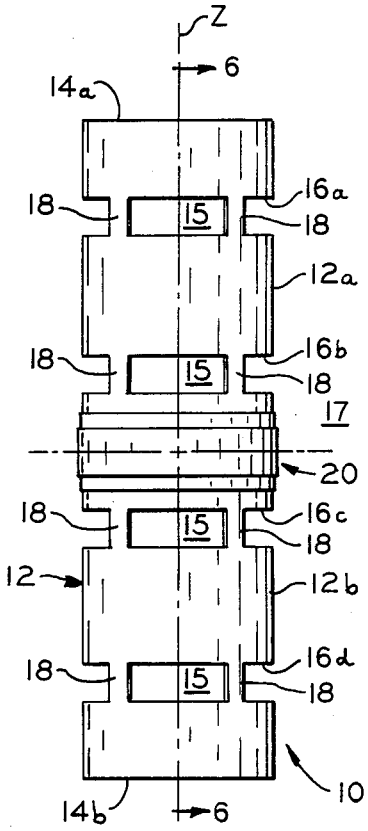
FIG. 2 is a side elevation view of the transducer shown in FIG. 1.
Figure 3:
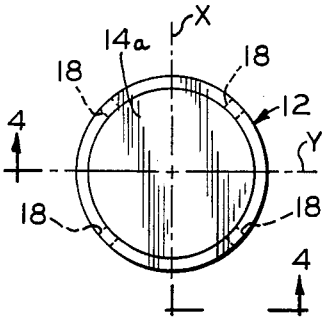
FIG. 3 is a top plan view of the phased array transducer shown in FIGS. 1 and 2.

Referring to FIGS. 1, 2, and 3 there are shown a pictorial, side, and top views respectively of a phased transducer array 10. The transducer array 10 comprises an elongated cylindrical tube 12 of a suitable material such as a metal or a rigid plastic and has suitable longitudinal and diameter dimensions depending on the desired acoustical frequency range and desired beam pattern for which transducer array 10 is designed. Tube 12 is of a suitable material to provide an acoustic transmission path boundary for acoustic waves traveling interiorly of the tube. Such tube material may be of a metal or a rigid plastic and the tube has suitable longitudinal and diametral dimensions depending on the desired acoustical frequency range and desired beam pattern for which tansducer array 10 is designed. It is preferred that tube 12 material have a low acoustic transmissivity, high insensitivity to acoustic vibrations, and low acoustic absorption. Aluminum has been used as a tube material. Tube 12 has ends 14*a*, 14*b* at the upper and lower ends, respectively, thereof and a plurality of substantially annular apertures or ports 16*a*, 16*b*, 16*c*, 16*d* formed in the wall of tube 12 at predetermined longitudinally spaced apart locations along the length dimension of tube 12. Apertures 16*a*–16*d*each provide an acoustic coupling port between the internal transmission medium 15 internally of tube 12 and the external transmission medium 17 externally of tube 12.

Ports 16*a*–16*d* are each formed of four equal arcuate apertures separated by longitudinal struts or ribs 18 which join portions of tube 12 above and below ports 16*a*–16*d* to provide longitudinal structural integrity of tube 12.

Ribs 18 are preferably made as thin as possible in the circumferential direction and still maintain the structural rigidity of tube 12. Also, it is preferable that ribs 18 are equally spaced about the circumference of their respective ports to achieve wave pattern symmetry. The width of ribs 18 in the circumferential direction should be enough to provide structural integrity of tube 12 and to offer a means of uncoupling adverse resonances in the tube 12. However, the width should be small compared to the wavelength of the acoustic wave in the medium so that the ribs 18 do not limit the transmission of the acoustical wave through a port aperture and do not interfere with the incoming wave when the transducer array 10 is receiving and forming sine and cosine like directivity patterns in the X-Y plane. For example, a ratio of rib width to wavelength of 1:15 is acceptable. Also a ratio of rib width to one quarter of tube 12 circumference of 1:6 was found to be acceptable. These ratios are a good compromise of acoustic performance and structural integrity of tube 12. Tube 12 comprises an upper elongated portion 12*a* and a lower elongated portion 12*b*. A hollow cylindrical or ring electroacoustical transducer element 20 is supported between portions 12*a*, 12*b*.

Figure 4:
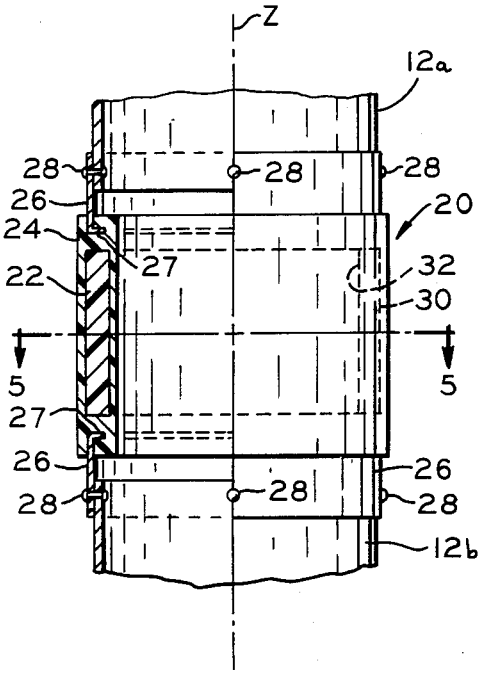
FIG. 4 is an enlarged partial quarter sectional view of the transducer element portion of the transducer shown in FIGS. 1, 2, and 3 taken along the lines 4—4 of FIG. 3.
Figure 5:
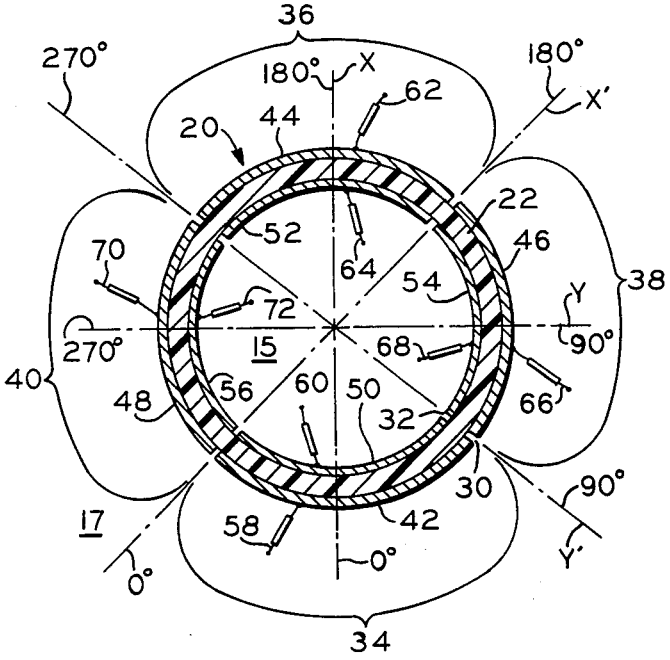
FIG. 5 is an enlarged partial cross sectional view of the transducer element taken along the lines 5—5 in FIG. 4.
Figure 6:
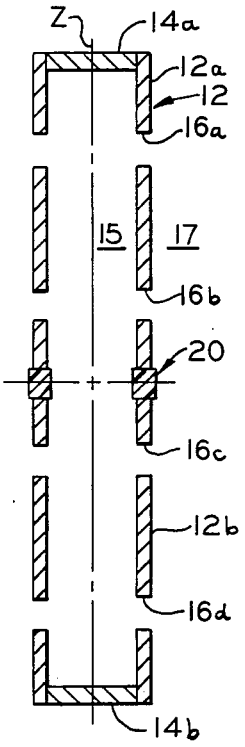
FIG. 6 is a partial and simplified cross sectional view taken along line 6—6 of the phased array transducer of FIG. 2 showing the relationship between the cylindrical transducer element and the annular ports in the wall of the cylindrical tube.

Referring to FIGS. 4–6, element 20 comprises a hollow cylinder or ring 22 of an electroacoustic material such as piezolectric material polarized to vibrate in a radial mode although other vibrational modes and types of electroacoustic transducer material can be used. A typical piezoelectric material is lead zirconate titanate. Element 20 is embedded or encapsulated in a suitable encapsulating material 24 such as an elastomeric or polymeric material which can be cast or molded about element 20. Also embedded in material 24 and concentrically positioned with and longitudinally spaced apart from each end edge of element 20 is a cylindrical mounting ring bracket 26, which brackets 26 are in turn affixed to portions 12*a*, 12*b* by arcuately spaced rivets 28 or other suitable fastening means such as, for example, machine screws or an epoxy adhesive. Material 24 provides mechanical support for element 20, is acoustically transparent to provide relatively good acoustical coupling between element 20 and internal liquid medium 15 and external liquid medium 17, and aids in minimizing direct transmission of acoustic vibrations between element 20 and tube portions 12*a*, 12*b*, which vibrations degrade the performance of the transducer array. The longitudinal spacing between brackets 26 provides a window area or port 27 for transmission of acoustic waves to and from element 20. Since the present invention is intended primarily for use in underwater applications, protection of the transducer element 20, and its electrodes, later described, from their environment is important and is provided by the encapsulating material 24. Material 24 can be comprised of layers or a combination of different materials to provide the above properties.

Referring to FIG. 5, in which material 24 has been omitted for purposes of clarity, piezoelectric ring 22 has outer vibratile surface 30 and inner vibratile surface 32. Ring 22 is comprised of quadrants 34, 36, 38, 40, having outer electrodes 42, 44, 46, 48, respectively, affixed in conventional manner to outer surface 30 and inner electrodes 50, 52, 54, 56 respectively, affixed in conventional manner to inner surface 32. Thus, electrode pair 42, 50 is in quadrant 34; electrode pair 44, 52 is in quadrant 36; electrode pair 46, 54 is in quadrant 38; and electrode pair 48, 56 is in quadrant 40. Each electrode covers substantially all of its respective quadrant and is spaced from the adjacent electrode on either arcuate side to prevent electrical communication with any other electrode. The electrodes are applied to their respective surfaces 30, 32 in a manner known to the art such as vapor deposition and are of a conductive material such as silver. Electrical leads 58, 60, 62, 64, 66, 68, 70, 72 are electrically coupled to electrodes 42, 50, 44, 52, 46, 54, 48, 56, respectively. Electrodes 42–56 are encapsulated in material 24. Leads 58–72 provide connections between their respective electrodes and external utilization circuitry.

Figure 6A:
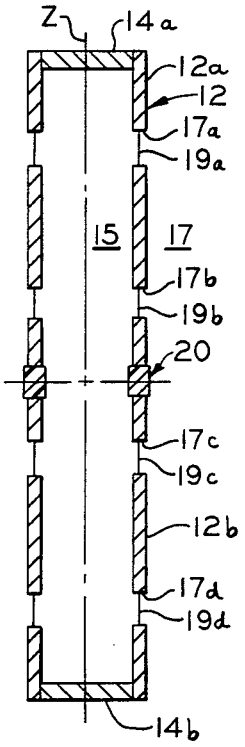
FIG. 6*a* is a view similar to FIG. 6 wherein acoustically transparent membranes cover the annular ports.

Referring to FIG. 6A tube 12 has annular ports 17*a*, 17*b*, 17*c*, 17*d* corresponding to and similar in construction and function to ports 16*a*, 16*b*, 16*c*, 16*d* respectively in the embodiment of FIGS. 1–4. Acoustically transmissive membranes 19*a*, 19*b*, 19*c*, 19*d* are sealed to tube 12 at the edges of ports 17*a*, 17*b*, 17*c*, 17*d* respectively to prevent any flow of internal transmission medium 15 therethrough and seal medium 15 inside tube 12. Medium 15 is selected for its acoustic wave velocity property, which affects the wavelength and phase shift at a given frequency. Medium 15 may be silicone oil or other material having desired acoustic properties. Wavelength varies directly as wave velocity, and for a given port 17*a*–17*d*spacing, varying the relative wave velocity will correspondingly vary the phase shift of the internal wave at the ports. The present invention can also be used with the array of FIG. 6A.

As will be apparent to those skilled in the art, in the receiving mode of transducer array 10, planar response patterns for use in determining directivity of a received acoustical signal can be provided by connections as explained in the previously referenced parent Congdon application. The difference in relative output signals from the electrode pair for opposite quadrants 34, 36 will provide a measure of the pressure gradient existing diametrically across the element 20 and will be maximum for acoustic wave front travel in a direction along the X axis and minimum for wave front travel in a direction along the Y axis thus providing a cosine-like directional field pattern such as shown by dashed line 76 of FIG. 7. Likewise, the difference in output signals of the electrode pair for opposite quadrants 38, 40 provides the sine-like field pattern shown by solid line 78 of FIG. 7, being maximum for a received wave front along the Y axis and minimum for a received wave front along the X axis. As used herein, the terms "sine" and "cosine" patterns refer in general to sine-like and cosine-like patterns since the actual patterns obtained may vary from exact sine and cosine patterns.

Figure 7:
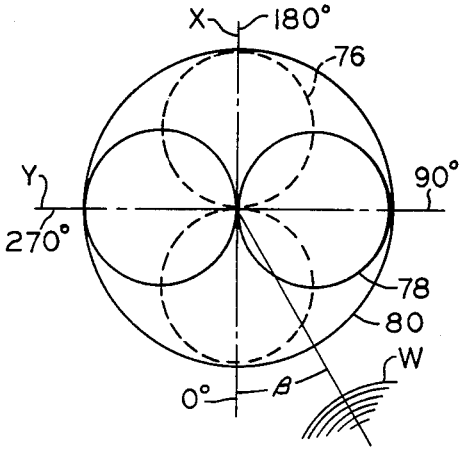
FIG. 7 shows typical sine/cosine like directional field patterns and a typical omnidirectional field pattern which patterns are in a plane containing the X and Y axes.
Figure 8:
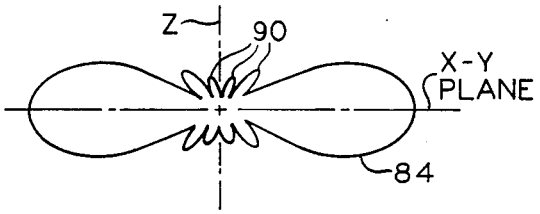
FIG. 8 shows a typical directional field pattern in a plane containing the Z axis and generated broadside of the Z axis in conjunction with the field patterns of FIG. 7.

Adding or averaging of the output signals from all four electrode pairs from all four quadrants 34, 36, 38, 40 will provide an omnidirectional field pattern as shown by line 80 in FIG. 7. Other patterns, such as cardioid patterns, can be obtained as is known in the art. In the transmitting mode of transducer array 10, properly phased electrical signals can be applied to the corresponding quadrant electrode pairs of element 20 to generate an omnidirectional or directional acoustical wave patterns as may be desired. Various of the electrodes can for example be connected together or combined to form a single continuous outer electrode and in a like manner, and in lieu thereof, the inner electrodes can be connected in common or made a single continuous inner electrode.

Although the herein phased array transducer can provide horizontal directional patterns for both transmitting and receiving acoustic wave signals, the directional transmitting properties are not generally required when the transducer array is used in typical sonobuoy applications. As examples, in a passive type sonobuoy which operates to provide only the reception of acoustic signals, the transducer array would normally operate in the receive mode to provide desired horizontal directional and/or omnidirectional receiving patterns. In an active type sonobuoy which operates to provide both the transmission and reception of acoustic signals, the transducer array would normally operate to provide an omnidirectional pattern in the transmit mode while providing the desired directional and/or omnidirectional horizontal patterns in the receiving mode. As mentioned, circuitry to perform the electrical combining of output signals is disclosed in the previously referenced copending parent Congdon application, incorporated herein by reference.

Referring to FIGS. 1–8, the operation of transducer array 10 will be described. Transducer array 10 is reciprocal, i.e. it can transmit acoustic waves in the transmission medium from electrical input signals or it can receive acoustic waves in the transmission medium and convert them into electrical output signals. The receive mode of transducer array 10 will be described, it being understood that the operation in the transmit mode is the reciprocal or reverse thereof and the field pattern shown and described represent both the transmitting and receiving properties or capabilities of transducer array 10.

Transducer array 10 is typically suspended and flooded in a transmission medium, which is water when the transducer is used as a hydrophone, so that its longitudinal axis Z is vertical. When the direction of travel of acoustic wave front W impinges transducer array 10 at an angle $\beta$ with axis X in the horizontal plane, it impinges the external surface of element 20, and also enters ports 16*a*–16*d* and the waves entering ports 16*a*–16*d* are phase shifted and then impinge the internal surface of element 20 to reinforce the vibrational effect on element 20 of wave W on the external surface of element 20. Thus a resultant electrical output signal having a relatively high signal to noise ratio is provided by the transducer array 10. The signal to noise ratio is increased since lobe 84 is relatively narrow in the vertical plane and side lobes 90 are suppressed thereby rejecting responses from directions other than the main lobe direction.

In the transmitting mode, the above is reversed and electrical signals are transmitted to element 20 causing surfaces 30, 32 to vibrate and generate acoustical waves in the respective coupled transmission mediums. The waves from internal surface 32 travel internally of tube 12 and exit ports 16*a*–16*d* with a phase and amplitude to reinforce the wave from external surface 30 in the desired direction of travel.

Figure 9:
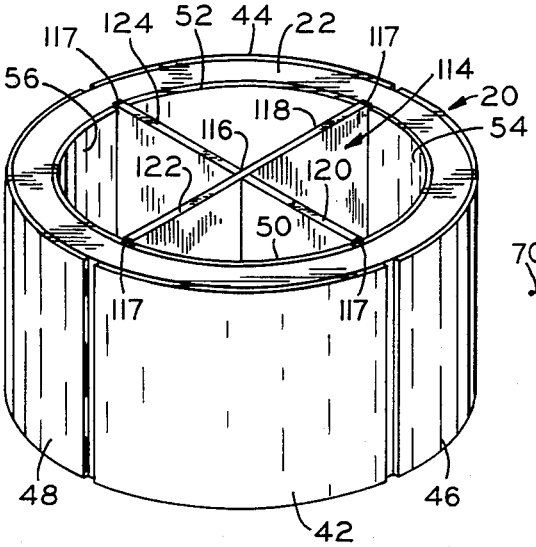
FIG. 9 is an enlarged view in perspective of a cylindrical electroacoustic transducer element in combination with a quadrant electroacoustic transducer element baffle in accordance with the present invention.
Figure 10:
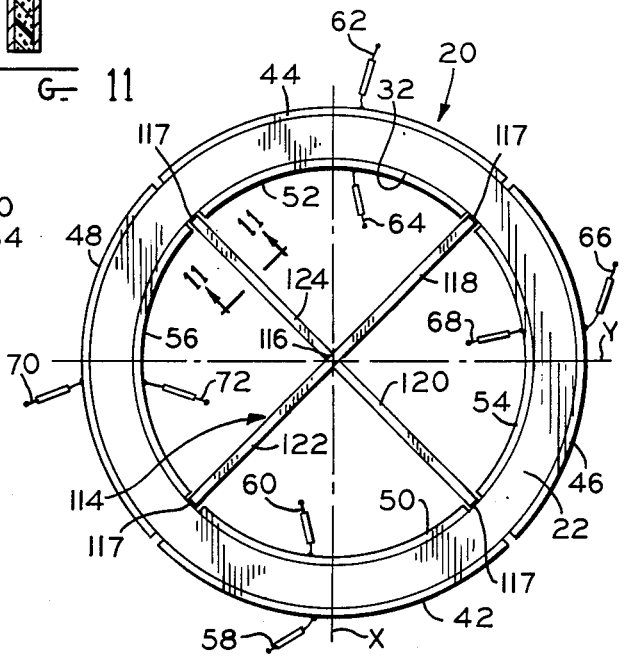
FIG. 10 is a top plan view of the cylindrical electroacoustic transducer element and the element baffle shown in FIG. 9.

This invention provides a baffle construction for improving the coupling between the transducer element 20 and the liquid transmission internal medium 15. Referring to FIGS. 9 and 10, cavity baffle 114 is mounted in the flooded or liquid filled cavity or central space defined by the inner walls of transducer element 20. Cavity baffle 114 has center axis 116 and radially extending partitions 118, 120, 122, 124 all of which extend toward but are separated from direct contact with the inner wall 32 of ring 22. The respective ends of the extending partitions may be affixed to the inner wall of ring 22 using a resilient material such as for example a polyurethane strip 117. It is desired that the ends of the partitions be acoustically isolated from the ring to prevent transmission of acoustic vibrations between the ring and the extending partitions. Other materials, methods and structures of affixing the cavity baffle 114 to the inside of transducer element 20 or attaching to tube 12 as for example at four properly arcuately spaced ribs 18 may be used. Partition 118 is between electrodes 52, 54; partition 120 is between electrodes 54, 50; partition 122 is between electrodes 50, 56; and partition 124 is between electrodes 56, 52. In general, where sine and cosine like horizontal field patterns are desired, the number of partitions is equal to the number of electrode pairs such as is shown in FIGS. 9 and 10. Likewise a cavity baffle can be used with other configurations of the transducer element 20. In a telescoping array as disclosed in application entitled "Extendible Sonobuoy Apparatus", inventors John C. Congdon, Thomas A.

Richter and Joseph J. Slachta and filed herewith, Ser. No. 06/748,751 filed June 26, 1985 the baffle partitions may be extendibly deployed in the outer container to a location within and with proper rotational relationship with the transducer element.

In any case of the transducer element 20 providing horizontal directional patterns such as shown in FIG. 7, the diametral partitions would lie along or be positioned on diametral lines intermediate the X, Y axes. In a transducer array in accordance with this invention having a transducer element for providing a single sine or cosine like pattern, such as for example the cosine pattern 76 of FIG. 7, a single partition can be used extending diametrically along the Y axis. Likewise, for the sine pattern response 78, the partition would lie along the X axis. In general, the partition or partitions of the baffle are positioned to lie along axes which intersect the theoretical and major minimum response points of the horizontal directional pattern or patterns. The partitions are coextensive longitudinally axially of element 20 to prevent direct transverse or chordal and diametral acoustical communication between one partitioned portion and another in the longitudinal or axial confines of element 20. The ends of baffle 114 are open to provide substantially unobstructed acoustic wave travel longitudinally of tube 12. If partitions axially shorter or less than the axial confines of element 20 are used, performance would be correspondingly degraded.

Figure 11:
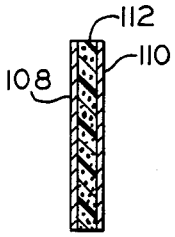
FIG. 11 is an enlarged partial cross sectional view of the baffle shown in FIG. 10 and taken along the line 11—11.

Cavity baffle 114 increases the effective pressure gradient to ceramic ring 22 of element 20 when the acoustic signal pressure of the ring cavity or central opening is utilized in the actuation of the ring, as it would be in the receiving mode. Baffle 114 also raises the resonant frequency within the cavity within ring 22 of element 20. Baffle 114 improves acoustic sine like and cosine like wave directivity in the horizontal plane. The partitions of baffle 114 have a low acoustic transmission and may be of a construction as described and shown in FIG. 11; layers 108, 110 may be of aluminum and layer 112 may be of an air containment screen mesh. Other materials and constructions of the partitions may be used that have low or minimum transparency to acoustic waves and are sufficiently rigid and rigidly supported to have low or minimum affect by and transfer of acoustic wave pressure variations. The number of partitions and their arrangement in the cavity of the electroacoustic transducer may be varied to suit particular applications of sector isolation in accordance with the principles of this invention.

Open ended "pie shaped" sectors are thus formed between the radial partitions 118–124. The surfaces of partitions 118–124 are continuous from one end of axis 116 to the other end and from axis 116 radially outwardly to inner wall 32 of the ring 22. Thus optimum chordal and diametral isolation of the cavity sectors one from the other is obtained.

Due to this isolation the pressure generated in the cavity by the acoustical vibration of wall 32 surface within a respective sector is chordally and diametrically isolated from the wall 32 surface in the other sectors. Thus, the pressure gradient across the cavity is increased improving the sine and cosine like directional patterns, of the kind shown in FIG. 7, sensitivity, and performance of the transducer. This invention may be used in other types and configurations of electroacoustic or electromechanical transducers to obtain improved results in both the transmitting and receiving modes. The baffle of this invention may be used with a single or a plurality of active electroacoustic transducer cavities in a single transducer or in a phased array of active transducers, or with a ported phased array transducer such as disclosed herein, or a phased array having a combination of active transducers and a ported tube.

The axial dimension of the baffles may be longer than the axial dimension of the ceramic ring 22 axis with results similar to those explained above and when substantially centered in the axial direction may be shorter than the ring axis in order to provide a desired impedance match with the tube 12 to tune the resonant frequency between the baffle and the ring as desired. However, when the axial dimension of the baffles is shorter than the axial dimension of the ring axis, some chordal and diametral isolation between the ring electrodes is lost. Also, other means may be used to attach the ceramic ring to the tube. Further, the ceramic ring may be larger in diameter than the tube, the tube extending through and attached to the ring so that the ring may vibrate substantially unrestricted by the tube.

While there have been described above the principles of this invention in connection with specific embodiments, it is to be understood that this is by way of example and is not limiting of the scope of this invention.

What is claimed is:

1. An electroacoustic transducer for transmitting or receiving acoustic waves within an operating frequency range in a liquid transmission external medium comprising:

electroacoustic transducer means for transducing between electrical and acoustical signals and having at least first and second vibratile surfaces capable of radiating and responding to acoustic waves in a liquid transmission medium coupled respectively thereto;

said transducer means comprising an electroacoustic transducer ring having opposite ends, an end to end axis, inner and outer surfaces, and adapted to be filled with a liquid transmission internal medium, said inner surface defining a ring cavity; said first vibratile surface comprising said ring outer surface and said second vibratile surface comprising said ring inner surface;

cavity baffle means being placed in said ring cavity for forming a plurality of separate cavity compartments each of which define a respective section of said inner surface;

mounting means for mounting said baffle means in said cavity that does not rigidly affix said baffle means to said ring so that each point of said ring is substantially free to vibrate and to substantially prevent transmission of acoustic vibration between said ring and said baffle means;

each said compartment transversely separating a respective one of said surface sections of said inner surface from the remaining sections of said inner surface so that the resonant frequency within each of said compartments is higher than the resonant frequency within said cavity without said compartments; each of said compartments having axial ends; conducting means for establishing acoustical communication between said internal and external mediums through at least one axial end of at least one of said compartments for obtaining a pressure gradient in said at least one compartment; whereby the acoustic wave pressure gradient to said inner surface of said ring is maintained over a predetermined operating frequency range.

2. The apparatus of claim 1 wherein said conducting means comprises openings in the axial ends of each of said compartments.

3. The apparatus of claim 2 wherein there are four arcuately spaced electrodes, each said electrode covering substantially one quadrant of said inner surface and there being an arcuate spacing between adjacent edges of said electrodes; said partition means having an X-shaped transverse cross section and having four longitudinal edges parallel to said axis; each edge of said partition means being contiguous with a respective said arcuate spacing.

4. The apparatus of claim 3 wherein said mounting means comprises a resilient strip being affixed between each edge of said partition means and said inner surface at said respective arcuate spacing.

5. The apparatus of claim 1 wherein said ring has a plurality of arcuately spaced electrodes affixed to respective sections of said inner surface; said cavity baffle means comprising partition means positioned in said cavity and relative said ring inner surface to partition and substantially isolate in chordal and diametral directions at least one of said electrodes from other of said electrodes.

6. The apparatus of claim 5 wherein said partition means has individual partitions each having a substantially continuous surface extending from said axis to said inner surface for partitioning and isolating in chordal and diametral directions each of said electrodes from each of the other of said electrodes, said partition means being substantially open at its axial ends.

7. The apparatus of claim 6 wherein said partition means comprises two substantially rigid outer layers separated by an intermediate pressure release layer for reducing acoustical wave transmission; said mounting means comprises resilient means for providing a resilient acoustical seal between said inner surface and respective edges of said outer layers.

8. The apparatus of claim 6 wherein said partition means is substantially coextensive in the axial direction with the axial confines of said ring.

9. An electroacoustic transducer for transmitting or receiving acoustic waves within an operating frequency range in a liquid transmission external medium comprising:

electroacoustic transducer means for transducing between electrical and acoustical signals and having at least first and second vibratile surfaces capable of radiating and responding to acoustic waves in a liquid transmission medium coupled respectively thereto;

said transducer means comprising an electroacoustic tubular transducer having opposite ends, an end to end axis, inner and outer surfaces, and adapted to be filled with a liquid transmission internal medium, said inner surface defining a cavity; said first vibratile surface comprising said outer surface and said second vibratile surface comprising said inner surface;

cavity baffle means being placed in said cavity for forming a plurality of separate cavity compartments that divide said inner surface into a plurality of respective sections; each compartment transversely separating a respective one of said surface sections of said inner surface from the remaining sections of said inner surface so that the resonant frequency within each of said compartments is higher than the resonant frequency within said cavity without said compartments;

mounting said baffle means in said cavity that does not rigidly affix said baffle means to said tubular transducer so that each point of said tubular transducer is substantially free to vibrate and to substantially prevent transmission of acoustic vibration between said tubular transducer and said baffle means;

each of said compartments having axial ends; conducting means for establishing acoustical communication between said internal and external mediums through at least one end of at least one of said compartments for obtaining a pressure gradient in said at least one compartment; whereby the acoustic wave pressure gradient to said inner surface of said tubular transducer is maintained over a predetermined operating frequency range for transmitting or receiving acoustical signals.

10. The apparatus of claim 9 wherein said conducting means comprises openings in the axial ends of each of said compartments.

11. The apparatus of claim 10 wherein each said electrode covers a predetermined section area of said inner surface and there being a spacing between adjacent edges of said electrodes; said partition means having a plurality of edges substantially parallel to and contiguous with a respective said spacing to partition and substantially isolate in chordal and diametral directions at least one of said electrodes from other of said electrodes.

12. The apparatus of claim 11 wherein said mounting means comprises a resilient strip being affixed between each edge of said partition means and said inner surface at a said respective spacing.

13. The apparatus of claim 9 wherein said transducer has a plurity of spaced electrodes affixed to respective sections of said inner surface; said cavity baffle means comprising partition means positioned in said cavity and relative said transducer inner surface to partition and substantially isolate in transverse directions to said axis at least one of said electrodes from other of said electrodes.

14. The apparatus of claim 13 wherein said partition means has individual partitions each having a substantially continuous surface extending from said axis to said inner surface for partitioning and isolating in transverse directions each of said electrodes from each of the other of said electrodes.

15. The apparatus of claim 14 wherein said partition means comprises two substantially rigid outer layers separated by an intermediate pressure release layer for reducing acoustical wave transmission; said mounting means comprising resilient means for providing a resilient acoustical seal between said inner surface and respective edges of said outer layers.

16. The apparatus of claim 14 wherein said partition means is substantially coextensive in the axial direction with the axial confines of said cavity.

17. An electroacoustic transducer for transmitting or receiving acoustic waves within an operating frequency range in a liquid transmission external medium comprising:

an electroacoustic transducer means for transducing between electrical and acoustical signals and having at least first and second vibratile surfaces capable of radiating and responding to acoustic waves in a liquid transmission medium coupled respectively thereto;

said transducer means comprising an electroacoustic transducer ring having opposite ends, an end to end axis, inner and outer surfaces, and adapted to be filled with a liquid transmission internal medium, said inner surface defining a ring cavity; said first vibratile surface comprising said ring outer surface and said second vibratile surface comprising said ring inner surface;

cavity baffle means being placed in said ring cavity;

mounting means for mounting said baffle means in said cavity that does not rigidly affix said baffle means to said ring so that each point of said ring is substantially free to vibrate and to substantially prevent transmission of acoustic vibration between said ring and said baffle means;

a plurality of arcuately spaced electrodes affixed to said inner surface; said cavity baffle means comprising partition means positioned relative said ring inner surface to partition and substantially isolate in chordal and diametral directions at least one of said electrodes from other of said electrodes; said partition means having conducting means for establishing acoustical wave communication between said internal and external mediums through at least one of said ring ends to obtain a pressure gradient to said at least one electrode for transmitting or receiving acoustical signals.

* * * * *